US011626697B2

(12) United States Patent
Streckewald et al.

(10) Patent No.: US 11,626,697 B2
(45) Date of Patent: Apr. 11, 2023

(54) CABLE ASSEMBLY FOR ELECTRICAL CONNECTOR

(71) Applicant: TE Connectivity Services GmbH, Schaffhausen (CH)

(72) Inventors: Michael Streckewald, Harrisburg, PA (US); Julia Anne Lachman, York, PA (US); Sean Patrick McCarthy, Palmyra, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 0 days.

(21) Appl. No.: 17/179,766

(22) Filed: Feb. 19, 2021

(65) Prior Publication Data

US 2022/0271478 A1 Aug. 25, 2022

(51) Int. Cl.

| | |
|---|---|
| ***H01R 13/6591*** | (2011.01) |
| ***H01R 4/02*** | (2006.01) |
| ***H01R 13/6592*** | (2011.01) |
| ***H01B 11/00*** | (2006.01) |
| *H01B 7/02* | (2006.01) |

(52) U.S. Cl.

CPC ..... *H01R 13/65914* (2020.08); *H01B 11/002* (2013.01); *H01R 4/029* (2013.01); *H01R 13/6592* (2013.01); *H01B 7/02* (2013.01)

(58) Field of Classification Search

CPC ..... H01R 13/65914; H01R 4/029; H01R 13/6592; H01B 11/002; H01B 7/02

See application file for complete search history.

(56) References Cited

U.S. PATENT DOCUMENTS

| | | | | |
|---|---|---|---|---|
| 6,538,203 | B1 | 3/2003 | Nolle et al. | |
| 10,699,823 | B2 | 6/2020 | Blackburn et al. | |
| 2014/0051295 | A1* | 2/2014 | Westman | H01R 13/518 439/626 |
| 2016/0148720 | A1* | 5/2016 | Kanagawa | H01R 4/726 29/869 |
| 2020/0005966 | A1* | 1/2020 | Blackburn | H01B 11/002 |
| 2021/0242633 | A1* | 8/2021 | Yoshimura | H01R 13/6592 |

FOREIGN PATENT DOCUMENTS

| | | | |
|---|---|---|---|
| PL | 196506 | B1 * | 1/2008 |
| TW | M339803 | A | 9/2008 |

* cited by examiner

*Primary Examiner* — Travis S Chambers

(57) ABSTRACT

A cable assembly is provided and includes a cable core including a first signal conductor and a second signal conductor separated by at least one insulator. The first and second signal conductor both include exposed segments extending forward from their respective insulator to a conductor end. The cable assembly includes a contact holder extending between a front and a rear. The cable assembly includes a first contact received in the corresponding channel of the contact holder. The first contact has a mating end and a terminating end. The cable assembly includes a first contact and a second contact received in their corresponding channel of the contact holder. The first and second contact have a mating end and a terminating end. The terminating end has a weld edge welded to the conductor end at a butt weld.

17 Claims, 4 Drawing Sheets

CABLE ASSEMBLY FOR ELECTRICAL CONNECTOR

BACKGROUND OF THE INVENTION

The subject matter herein relates generally to electrical connectors.

High speed differential connectors are known and used in electrical systems, such as communication systems to transmit signals within a network. Some electrical systems utilize cable mounted electrical connectors to interconnect the various components of the system. Signal loss and/or signal degradation is a problem in electrical systems. Some known systems utilize shielding to reduce interference between the contacts of the electrical connectors, such as by using shielding components terminated to the cable shield of the cable. The transition between the shield and the cable shield negatively affects the signal integrity, including by impacting the impedance of the signals. Additionally, the termination between the signal conductors of the cables and the contacts of the electrical connector affect the signal integrity. For example, the overlap between the signal conductor and the signal contact creates an impedance drop along that section of the signal path. Additionally, the transition area of the signal conductor, from the insulator of the cable to the signal contact, has changes in shape and changes in dielectric material surrounding the signal conductor, which both affect signal integrity, such as by increasing impedance, thereby affecting return loss and increasing cross talk.

A need remains for an electrical connector having improved cable termination and shielding to meet particular performance demands.

BRIEF DESCRIPTION OF THE INVENTION

In one embodiment, a cable assembly is provided. The cable assembly includes a cable having a cable core including a first signal conductor and a second signal conductor separated by at least one insulator. The first signal conductor includes a first exposed segment extending forward of the first insulator to a first conductor end. The second signal conductor includes a second exposed segment extending forward of the second insulator to a second conductor end. The cable has a cable shield surrounding the cable core providing electrical shielding along a length of the cable. The cable assembly includes a contact holder extending between a front and a rear. The contact holder is located forward of the cable. The contact holder has contact channels extending between the front and the rear. The cable assembly includes a first contact received in the corresponding channel of the contact holder. The first contact has a mating end and a terminating end. The terminating end has a first weld edge welded to the first conductor end at a first butt weld. The cable assembly includes a second contact received in the corresponding channel of the contact holder. The second contact has a mating end and a terminating end. The terminating end has a second weld edge welded to the second conductor end at a second butt weld.

In another embodiment, a cable assembly is provided. The cable assembly includes a cable having a cable core including a first signal conductor and a second signal conductor separated by at least one insulator. The first signal conductor includes a first exposed segment extending forward of the first insulator to a first conductor end. The second signal conductor includes a second exposed segment extending forward of the second insulator to a second conductor end. The cable has a cable shield surrounding the cable core providing electrical shielding along a length of the cable. The cable assembly includes a contact holder extending between a front and a rear. The contact holder is located forward of the cable. The contact holder has contact channels extending between the front and the rear. The cable assembly includes a first contact received in the corresponding channel of the contact holder. The first contact has a mating end and a terminating end. The terminating end has a first weld edge welded to the first conductor end at a first butt weld. The cable assembly includes a second contact received in the corresponding channel of the contact holder. The second contact has a mating end and a terminating end. The terminating end has a second weld edge welded to the second conductor end at a second butt weld. The cable assembly includes a ground shield coupled to the contact holder and provides electrical shielding for the first and second contacts. The ground shield is electrically connected to the cable shield.

In a further embodiment, an electrical connector is provided. The electrical connector includes a housing having a front and a rear. The electrical connector includes a plurality of cable assemblies coupled to the housing and extending from the rear of the housing. Each cable assembly includes a cable having a cable core including a first signal conductor and a second signal conductor separated by at least one insulator. The first signal conductor includes a first exposed segment extending forward of the first insulator to a first conductor end. The second signal conductor includes a second exposed segment extending forward of the second insulator to a second conductor end. The cable has a cable shield surrounding the cable core providing electrical shielding along a length of the cable. Each cable assembly includes a contact holder extending between a front and a rear. The contact holder is located forward of the cable. The contact holder has contact channels extending between the front and the rear. Each cable assembly includes a first contact received in the corresponding channel of the contact holder. The first contact has a mating end and a terminating end. The terminating end has a first weld edge welded to the first conductor end at a first butt weld. Each cable assembly includes a second contact received in the corresponding channel of the contact holder. The second contact has a mating end and a terminating end. The terminating end has a second weld edge welded to the second conductor end at a second butt weld. Each cable assembly includes a ground shield coupled to the contact holder and providing electrical shielding for the first and second contacts. The ground shield is electrically connected to the cable shield.

DETAILED DESCRIPTION OF THE INVENTION

Figure 2:
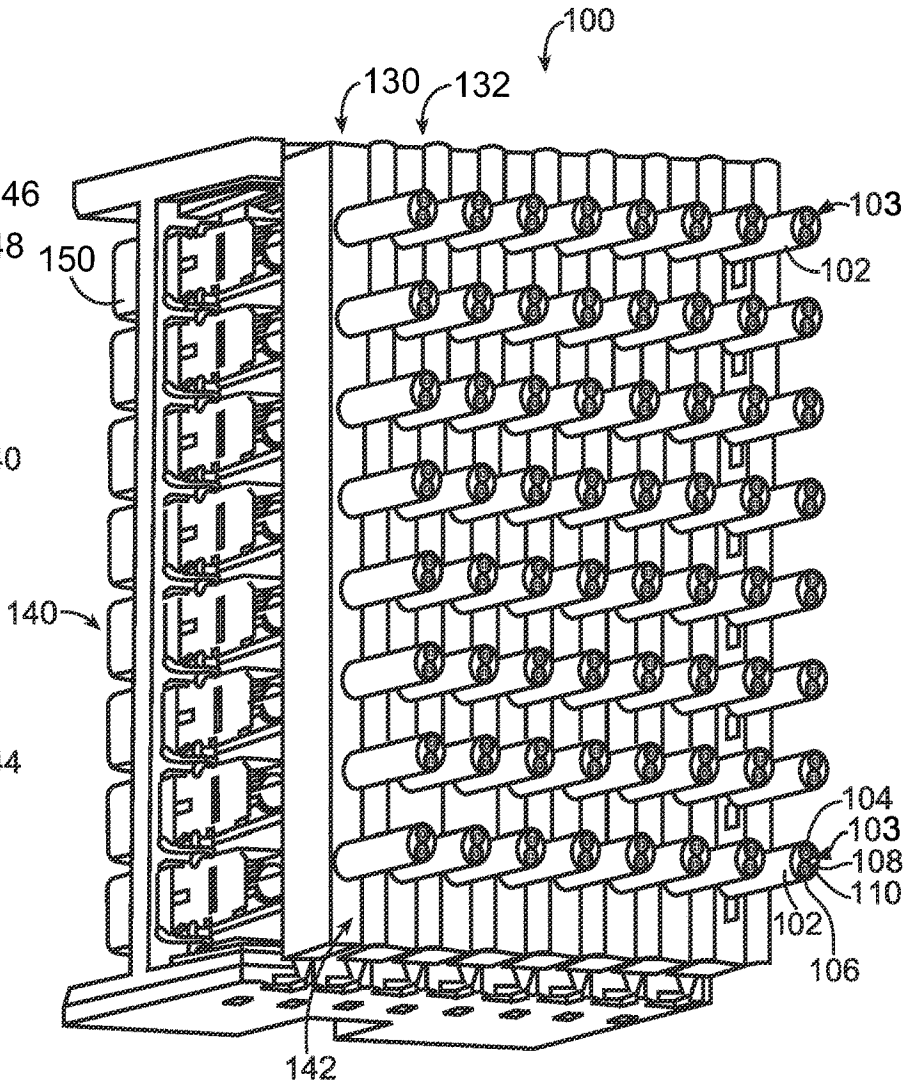
FIG. 2 is a rear perspective view of the electrical connector in accordance with an exemplary embodiment.
Figure 1:
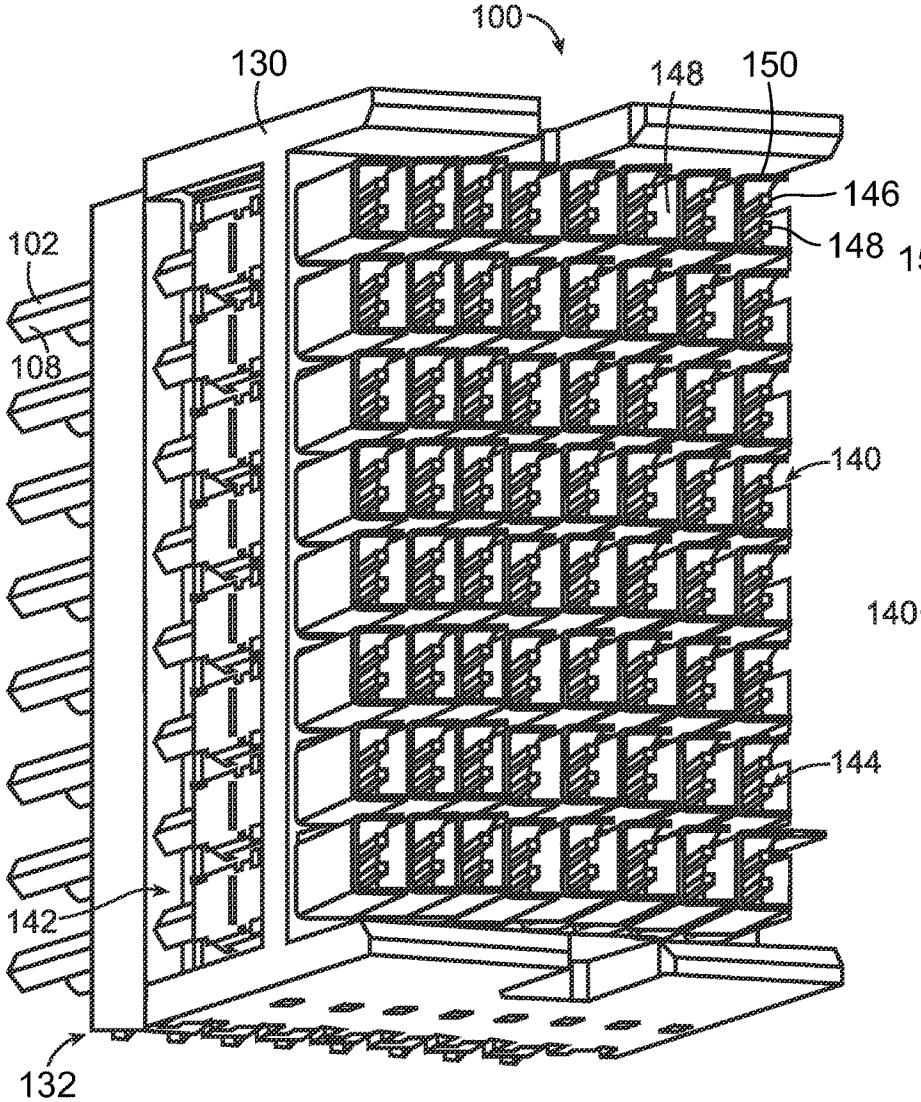
FIG. 1 is a front perspective view of an electrical connector formed in accordance with an exemplary embodiment.

FIG. 1 is a front perspective view of an electrical connector 100 formed in accordance with an exemplary embodiment. FIG. 2 is a rear perspective view of the electrical connector 100. In the illustrated embodiment, the electrical connector 100 is a cable header connector and may be referred to hereinafter as a cable header connector 100. The cable header connector 100 is configured to be mated with a mating electrical connector, such as a receptacle connector (not shown). The receptacle connector may be board mounted to a printed circuit board or terminated to one or more cables, for example. In an exemplary embodiment, the cable header connector 100 is a high-speed differential pair cable connector that includes a plurality of differential pairs of conductors mated at a common mating interface. The differential conductors are shielded along the signal paths thereof to reduce noise, crosstalk and other interference along the signal paths of the differential pairs. The cable shielding and arrangement of conductors may control impedance of the cable header connector 100.

A plurality of cables 102 extend rearward of the cable header connector 100. In an exemplary embodiment, the cables 102 are twin-axial cables having a pair of signal conductors within a cable core 103. Other types of cables 102 may be provided in alternative embodiments. For example, coaxial cables each carrying a single signal conductor may extend from the cable header connector 100. In an exemplary embodiment, the cable 102 includes first and second signal conductors 104, 106 within the cable core 103. The two signal conductors 104, 106 are arranged within a common jacket or dielectric cover 108 of the cable 102. The first and second signal conductors 104, 106 convey differential signals. The first and second signal conductors 104, 106 may be defined by separate signal wires each having a separate insulator and then arranged within the dielectric cover 108. Alternatively, the first and second signal conductors 104, 106 may be co-extruded in a single insulator arranged within the dielectric cover 108.

Figure 4:
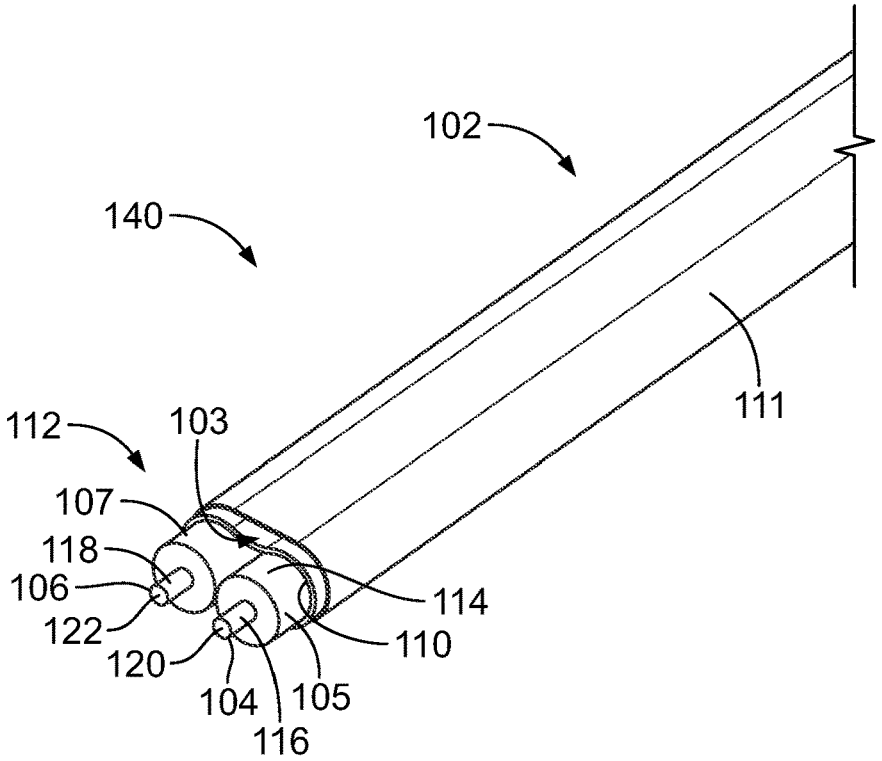
FIG. 4 is a top perspective view of a portion of the cable assembly showing the cable in accordance with an exemplary embodiment.

In an exemplary embodiment, the pair of signal conductors 104, 106 is shielded, such as with a cable shield 110 (shown in FIG. 4). The cable shield 110 defines a grounded element of the cable 102 forming part of a shield structure for the signal(s) of the cable 102. In various embodiments, the cable 102 is provided without a drain wire in the cable core 103, rather forming a symmetric cable core 103. However, alternative embodiments may include a drain wire electrically connected to the cable shield 110. The cable shield 110 of the cable 102 provides shielding for the signal conductors 104, 106 along the length of the cable 102 and may be electrically connected to other components, such as a ground shield for grounding connection to the mating electrical connector.

The cable header connector 100 includes a header housing 130 holding one or more contact modules 132. The contact modules 132 are loaded into the header housing 130, such as into a rear of the header housing 130. The header housing 130 holds the contact modules 132 in a stack with the contact modules 132 oriented parallel to each other such that the cable assemblies 140 are aligned in a column. Any number of contact modules 132 may be held by the header housing 130 depending on the particular application.

Each of the contact modules 132 includes a plurality of cable assemblies 140 held by a support body 142. Each cable assembly 140 includes a contact sub-assembly 144 configured to be terminated to a corresponding cable 102. The contact sub-assembly 144 includes first and second signal contacts 146, 148 terminated to corresponding signals conductors 104, 106. The cable assembly 140 also includes a ground shield 150 providing shielding for the signal contacts 146, 148. In an exemplary embodiment, the ground shield 150 peripherally surrounds the signal contacts 146, 148 along the entire length of the signal contacts 146, 148 to ensure that the signal paths are electrically shielded from interference. The ground shield 150 is configured to be electrically coupled to one or more grounded components, such as the cable shield 110, of the corresponding cable 102. The ground shield 150 is configured to be electrically coupled to the support body 142 for additional shielding and grounding. The ground shield 150 is configured to be electrically coupled to corresponding grounded components of the receptacle assembly when mated thereto.

The support body 142 provides support for the contact sub-assembly 144 and ground shield 150. In an exemplary embodiment, the cables 102 extend along the support body 142 with the support body 142 supporting a length or portion of the cables 102. The support body 142 may provide strain relief for the cables 102.

Figure 3:
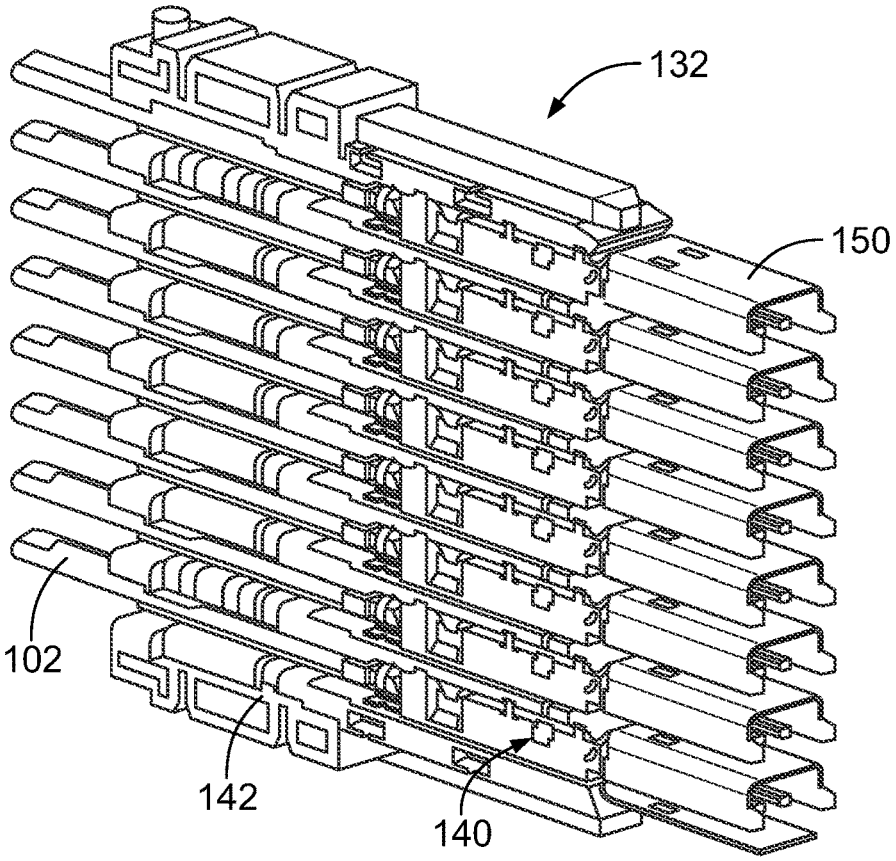
FIG. 3 is a perspective view of one of the contact modules in accordance with an exemplary embodiment.

FIG. 3 is a perspective view of one of the contact modules 132. The support body 142 supports the cable assemblies 140 and/or the cables 102. The cable assemblies 140 are mounted to the support body 142, such as in channels or slots in the support body 142. In various embodiments, a shield member (not shown) may be coupled to a first side and/or a second side of the support body 142 to provide shielding for the cable assemblies 140. The ground shields 150 may be electrically coupled to the shield member, such as using tabs, press-fit pins or other features such as latches, clips, fasteners, solder, and the like.

FIG. 4 is a top perspective view of a portion of the cable assembly 140 showing the cable 102 in accordance with an exemplary embodiment. In the illustrated embodiment, the cable core 103 includes the first signal conductor 104 and the second signal conductor 106; however, it is realized that the cable core 103 may include greater or fewer signal conductors in alternative embodiments. The cable core 103 includes a first insulator 105 around the first signal conductor 104 and a second insulator 107 around the second signal conductor 106. In various embodiments, the signal conductors 104, 106 and the corresponding insulators 105, 107 may be defined by separate insulated wires that are surrounded by the cable shield 110 and a dielectric cover 111. In other various embodiments, the first and second insulators 105, 107 may be formed from a single insulator member (dual extrusion insulator including the first insulator 105 around the first signal conductors 104 and the second insulator 107 around the second signal conductor 106) that surrounds both the first and second signal conductors 104, 106. For example, the single insulator member may be extruded with the first and second signal conductors 104, 106 such that the first and second insulators 105, 107 are formed from an integral, unitary or monolithic insulator body.

The cable shield 110 surrounds the cable core 103 and provides electrical shielding along the length of the cable 102. The dielectric cover 111 surrounds the cable shield 110 along the length of the cable 102 and provides environmental protection for the cable shield 110. The cable shield 110 and/or the dielectric cover 111 may be extruded with the cable core 103 during a cabling process. In other various embodiments, the cable shield 110 may be wrapped around the cable core 103.

In an exemplary embodiment, an end 112 of the cable 102 is prepared for termination to the first and second signal contacts 146, 148 (shown in FIG. 1). For example, a portion of the dielectric cover 111 may be stripped and removed leaving an exposed segment 114 of the cable shield 110 at the end 112 of the cable 102. The cable shield 110 is provided at a uniform and consistent distance from the signal conductors 104, 106 to control impedance of the signals transmitted by the cable 102. In an exemplary embodiment, a portion of the cable shield 110 is stripped and removed exposing the cable core 103. For example, ends of the insulators 105, 107 may be exposed beyond the end of the cable shield 110. Portions of the insulators 105, 107 may be stripped and removed leaving first and second exposed segments 116, 118 of the first and second signal conductors 104, 106 at the end 112 of the cable 102. The first and second exposed segments 116, 118 extend to first and second conductor ends 120, 122, respectively. The first and second exposed segments 116, 118 are configured to be terminated to the first and second signal contacts 146, 148. For example, the first and second conductor ends 120, 122 may be butt welded, end-to-end, to the first and second signal contacts 146, 148. For example, the first conductor end 120 may abut against the end or edge of the first signal contact 146 and the second conductor end 122 may abut against the end or edge of the second signal contact 148. In an exemplary embodiment, the signal conductors 104, 106 are cylindrical having a circular cross-section. The first and second exposed segments 116, 118 are cylindrical and the first and second conductor ends 120, 122 have a circular cross-section. The first and second conductor ends 120, 122 may be flat for butt welding to the first and second signal contacts 146, 148.

Figure 5:
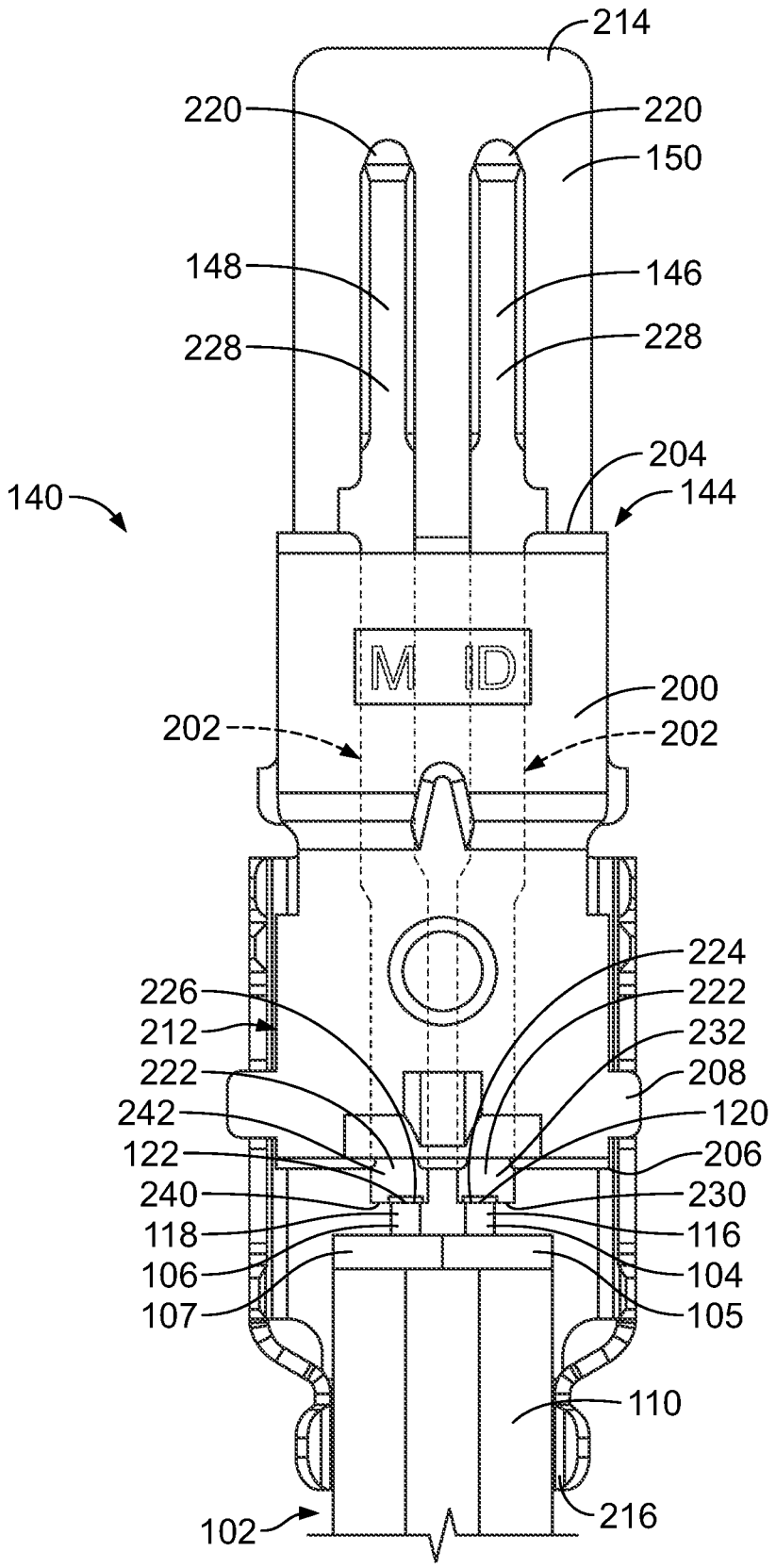
FIG. 5 is a bottom view of an end of the cable assembly in accordance with an exemplary embodiment.

FIG. 5 is an end view of the cable assembly 140 in accordance with an exemplary embodiment. The cable assembly 140 includes the cable 102 and the contact sub-assembly 144. The contact sub-assembly 144 includes a contact holder 200 that holds the first and second signal contacts 146, 148. The contact holder 200 includes contact channels 202 that receive corresponding signal contacts 146, 148 therein. The contact holder 200 may completely surround the signal contacts 146, 148 in various embodiments. For example, the contact holder 200 may be overmolded around portions of the signal contacts 146, 148 with the signal contacts 146, 148 passing through the contact holder 200 through the contact channels 202. In alternative embodiments, the first and second contact channels 202 may be open at a top of the contact holder 200 to receive the first and second signal contacts 146, 148 therein. The contact holder 200 is manufactured from a dielectric material and electrically isolates the signal contacts 146, 148 from each other. The contact holder 200 and contact channels 202 are designed for impedance control of the signal contacts 146, 148, with design consideration given to the shape of the signal contacts 146, 148, the spacing of the signal contacts 146, 148 and the dielectric characteristics of the material and/or air gaps between the signal contacts 146, 148 and/or the ground shield 150.

The contact holder 200 extends between a front 204 and a rear 206. In an exemplary embodiment, the signal contacts 146, 148 extend forward from the contact holder 200 beyond the front 204 and rearward from the contact holder 200 beyond the rear 206. The contact holder 200 includes locating posts 208 extending from opposite sides of the contact holder 200. The locating posts 208 are configured to position the contact holder 200 with respect to the ground shield 150 when the ground shield 150 is coupled to the contact holder 200 and/or the support body 142 when the cable assembly 140 is coupled to the support body 142.

The ground shield 150 has a plurality of walls that define a chamber 212 that receives the contact sub-assembly 144. The ground shield 150 extends between a mating end 214 and a terminating end 216. The mating end 214 is configured to be mated with the receptacle connector. The terminating end 216 is configured to be electrically connected to the cable 102. For example, the terminating end 216 of the ground shield 150 is electrically connected to the cable shield 110. The mating end 214 of the ground shield 150 is positioned either at or beyond the mating ends of the signal contacts 146, 148 when the cable assembly 140 is assembled. The terminating end 216 of the ground shield 150 is positioned either at or beyond terminating ends of the signal contacts 146, 148. The ground shield 150 provides shielding along the entire length of the signal contacts 146, 148. In an exemplary embodiment, the ground shield 150 provides shielding beyond the signal contacts 146, 148, such as rearward of the terminating ends and/or forward of the mating ends. In an exemplary embodiment, the ground shield 150 extends along at least a portion of the cable 102 to ensure that all sections of the signal conductors 104, 106 are shielded.

The signal contacts 146, 148 may be stamped and formed contacts. The signal contacts 146, 148 may be similar to each other, such as being identical, and like components may be referred to with like reference numerals. The signal contacts 146, 148 extend between mating ends 220 and terminating ends 222. In an exemplary embodiment, the signal contacts 146, 148 have pins 228 at the mating ends 220. The pins 228 extend forward from the front 204 of the contact holder 200. The pins 228 are configured to be mated with corresponding receptacle contacts (not shown) of the receptacle connector (not shown).

The first and second signal contacts 146, 148 are terminated to the first and second signal conductors 104, 106, respectively, of the cable 102 at the terminating ends 222. In an exemplary embodiment, the terminating ends 222 of the first and second signal contacts 146, 148 are welded to the first and second exposed segments 116, 118 of the first and second signal conductors 104, 106 at first and second butt welds 224, 226. The butt welds 224, 226 reduce lengths of the exposed segments 116, 118 as compared to lap welds (where the exposed segments 116, 118 overlap sides of the terminating ends 222 of the signal contacts 146, 148. The butt welds 224, 226 have shorter or smaller weld interfaces as compared to lap welds of conventional assemblies, which tends to affect impedance. The signal paths through the butt welds 224, 226 have improved impedance (for example, less drop in impedance) as compared to signal paths that would pass through lap welds. Additionally, lengths of the terminating ends 222 may be reduced by using the butt welds 224, 226 rather than lap welds.

In an exemplary embodiment, the first exposed segment 116 extends along a straight path from the insulator 105 to the first conductor end 120 and the second exposed segment 118 extends along a straight path from the insulator 107 to the second conductor end 122. As such, the exposed segments 116, 118 do not have bends or other changes in direction to change relative distances between the exposed segments 116, 118 and the ground shield 150. Having straight exposed segments 116, 118 improves signal integrity along the signal paths as compared to assemblies that have bent (non-straight) exposed segments. For example, bends in the exposed segments 116, 118 may cause increases in return loss and/or cross talk and straight exposed segments are not subject to increases in return loss or cross talk. In an exemplary embodiment, the first and second exposed segments 116, 118 are relatively short between the insulators 105, 107 and the signal contacts 146, 148. For example, the first and second exposed segments 116, 118 may be less than 1.0 cm. In various embodiments, the first and second exposed segments 116, 118 may be less than 0.5 cm, such as approximately 1.0 mm. The short lengths of the exposed segments 116, 118 improves signal integrity along the signal paths. For example, the lengths of the signal paths subject to higher impedance (for example, forward of the cable shield and/or surrounded by air or dielectric other than the dielectric of the insulators 105, 107) is reduced or minimized.

The terminating end 222 of the first signal contact 146 includes a first weld edge 230 at the rear of the first signal contact 146. The first weld edge 230 extends between a first side 232 and a second side 234 (shown in FIG. 6). The first and second sides 232, 234 are planar and defined by the main sides of the metal sheet from which the first signal contact 146 is stamped. The first weld edge 230 is a cut edge formed during the stamping process. The first weld edge 230 is configured to be welded to the first conductor end 120 at the first butt weld 224.

The terminating end 222 of the second signal contact 148 includes a second weld edge 240 at the rear of the second signal contact 148. The second weld edge 240 extends between a first side 242 and a second side 244 (shown in FIG. 6). The first and second sides 242, 244 are planar and defined by the main sides of the metal sheet from which the second signal contact 148 is stamped. The second weld edge 240 is a cut edge formed during the stamping process. The second weld edge 240 is configured to be welded to the second conductor end 122 at the second butt weld 226.

During assembly, the first conductor end 120 abuts against the first weld edge 230 of the first contact 146 and the second conductor end 122 abuts against the second weld edge 240 of the second contact 148. The first conductor end 120 is located rearward of the first weld edge 230 for butt welding thereto and the second conductor end 122 is located rearward of the second weld edge 240 for butt welding thereto. In an exemplary embodiment, the entire first exposed segment 116 is rearward of the first contact 146 and the entire second exposed segment 118 is rearward of the second contact 148. For example, the first exposed segment 116 does not overlap the terminating end 222 of the first contact 146 and the second exposed segment 118 does not overlap the terminating end 222 of the second contact 148. In other words, the first conductor end 120 is not overlapping either side 232, 234 of the first contact 146 at the terminating end 222 and the second conductor end 122 is not overlapping either side 242, 244 of the second contact 148 at the terminating end 222. The first conductor end 120 is butt welded to the first weld edge 230 of the first contact 146 at the first butt weld 224. For example, the first conductor end 120 is laser welded to the first weld edge 230 or ultrasonically welded to the first weld edge 230. The second conductor end 122 is butt welded to the second weld edge 240 of the second contact 148. For example, the second conductor end 122 is laser welded to the second weld edge 240 or ultrasonically welded to the second weld edge 240.

Figure 6:
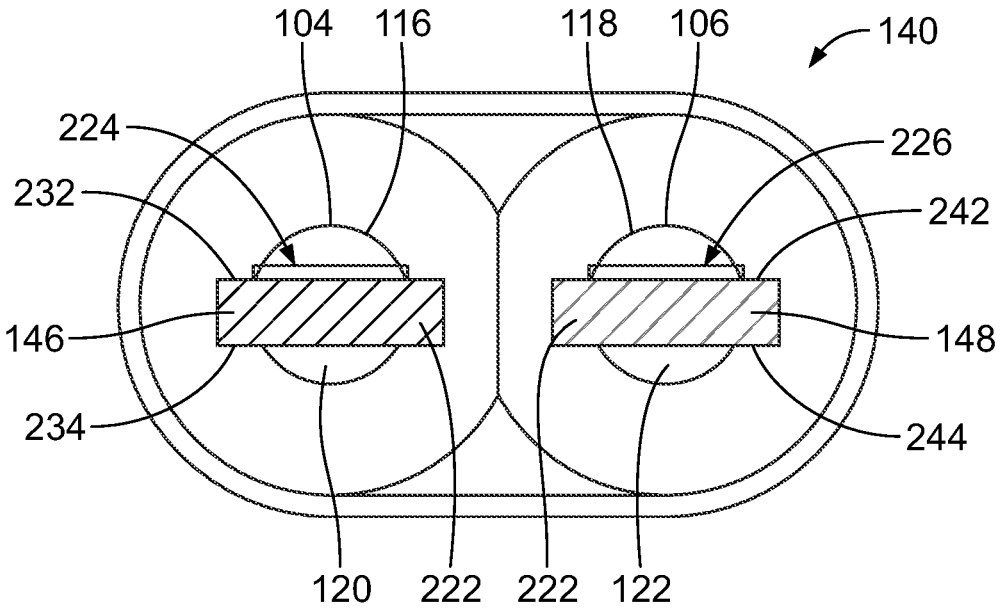
FIG. 6 is a cross-sectional view of a portion of the cable assembly showing the interface between the signal conductors and the signal contacts in accordance with an exemplary embodiment.

FIG. 6 is a cross-sectional view of a portion of the cable assembly 140 taken vertically through the signal conductors 104, 106 and the signal contacts 146, 148 showing the interface between the signal conductors 104, 106 and the signal contacts 146, 148. The first and second conductor ends 120, 122 are butt welded to the terminating ends 222 of the signal contacts 146, 148 at the first and second butt welds 224, 226. For example, the first conductor end 120 is welded to the terminating end 222 of the first signal contact 146 at the first side 232 and/or the second side 234 and the second conductor end 122 is welded to the terminating end 222 of the second signal contact 148 at the first side 242 and/or the second side 244. The first signal contact 146 is aligned with the first exposed segment 116 and the second contact 148 is aligned with the second exposed segment 118. The first conductor end 120 has a circular weld interface abutting against the first weld edge 230 and the second conductor end 122 has a circular weld interface abutting against the second weld edge 240.

In an exemplary embodiment, the terminating end 222 of the first signal contact 146 has a thickness between the first and second sides 232, 234. The first signal conductor 104 at the first conductor end 120 has a diameter greater than the thickness of the first signal contact 146 such that the first signal conductor 104 extends beyond the first side 232 and extends beyond the second side 234. The terminating end 222 of the second signal contact 148 has a thickness between the first and second sides 242, 244. The second signal conductor 106 at the second conductor end 122 has a diameter greater than the thickness of the second signal contact 148 such that the second signal conductor 104 extends beyond the first side 242 and extends beyond the second side 244.

Figure 7:
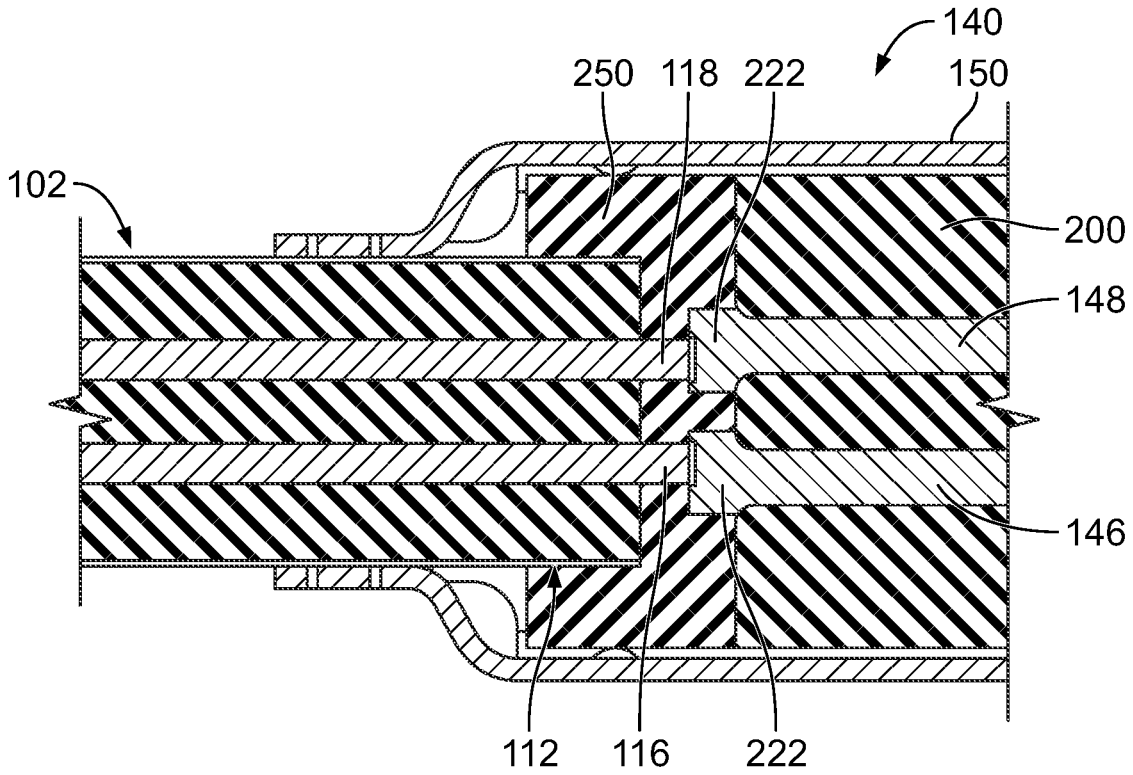
FIG. 7 is a cross-sectional view of a portion of the cable assembly in accordance with an exemplary embodiment.

FIG. 7 is a cross-sectional view of a portion of the cable assembly 140 taken horizontally through the cable assembly 140 showing the signal conductors 104, 106 and the signal contacts 146, 148 in accordance with an exemplary embodiment. During assembly, portions of the cable assembly 140 are covered, such as to provide strain relief and/or to improve signal integrity along the signal paths. The cable assembly 140 includes a dielectric cover 250 covering the end 112 of the cable 102, the first and second exposed segments 116, 118, and the terminating ends 222 of the first and second contacts 146, 148. The cover 250 is manufactured from a dielectric material, such as an acrylic material, a hot melt adhesive, a low pressure polymer material, and the like. Optionally, the cover 250 may be formed in place after the exposed segments 116, 118 are butt welded to the terminating ends 222. For example, the cover 250 may be overmolded or poured in place. The cover 250 may be a hot melt at least partially filling the space between the cable 102, the holder 200 and the ground shield 150. The cover 250 surrounds the signal paths (for example, exposed segments 116, 118 and terminating ends 222) with dielectric material other than air, such as for impedance control along the signal paths. For example, the dielectric material of the cover 250 may be similar to the dielectric material of the contact holder 200 and/or the insulators 105, 107. The material selected for the cover 250 may be selected to control impedance.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A cable assembly comprising:

a cable having a cable core including a first signal conductor and a second signal conductor separated by at least one insulator, the first signal conductor includes a first exposed segment extending forward of the first insulator to a first conductor end, the second signal conductor includes a second exposed segment extending forward of the second insulator to a second conductor end, the cable having a cable shield surrounding the cable core providing electrical shielding along a length of the cable;

a contact holder extending between a front and a rear, the contact holder located forward of the cable, the contact holder having contact channels extending between the front and the rear;

a first contact received in the corresponding channel of the contact holder, the first contact having a mating end and a terminating end, the terminating end having a first weld edge welded to the first conductor end at a first butt weld, wherein the terminating end of the first contact includes a first side and a second side opposite the first side, the first weld edge extending between the first and second sides; and a second contact received in the corresponding channel of the contact holder, the second contact having a mating end and a terminating end, the terminating end having a second weld edge welded to the second conductor end at a second butt weld, wherein the terminating end of the second contact includes a first side and the second side opposite the first side, the second weld edge extending between the first side and the second side;

wherein the first signal conductor has a diameter greater than a thickness of the first contact between the first and second sides such that the first signal conductor is beyond the first side of the first contact and beyond the second side of the first contact, and wherein the second signal conductor has a diameter greater than a thickness of the second contact between the first and second sides such that the second signal conductor is beyond the first side of the second contact and beyond the second side of the second contact.

2. The cable assembly of claim 1, wherein the first conductor end abuts against the first weld edge of the first contact and the second conductor end abuts against the second weld edge of the second contact.

3. The cable assembly of claim 1, wherein the first conductor end is rearward of the first weld edge and the second conductor end is rearward of the second weld edge.

4. The cable assembly of claim 1, wherein the entire first exposed segment is rearward of the first contact and the entire second exposed segment is rearward of the second contact.

5. The cable assembly of claim 1, wherein the first conductor end does not overlap the terminating end of the first contact and the second conductor end does not overlap the terminating end of the second contact.

6. The cable assembly of claim 1, wherein the first conductor end has a circular weld interface abutting against the first weld edge and the second conductor end has a circular weld interface abutting against the second weld edge.

7. The cable assembly of claim 1, wherein the first contact is aligned with the first exposed segment and the second contact is aligned with the second exposed segment.

8. The cable assembly of claim 1, wherein the first exposed segment is straight from the insulator to the first conductor end, and wherein the second exposed segment is straight from the insulator to the second conductor end.

9. The cable assembly of claim 1, further comprising an cover covering the end of the cable, the first and second exposed segments, and the terminating ends of the first and second contacts.

10. A cable assembly comprising:

a cable having a cable core including a first signal conductor and a second signal conductor separated by at least one insulator, the first signal conductor includes a first exposed segment extending forward of the first insulator to a first conductor end, the second signal conductor includes a second exposed segment extending forward of the second insulator to a second conductor end, the cable having a cable shield surrounding the cable core providing electrical shielding along a length of the cable;

a contact holder extending between a front and a rear, the contact holder located forward of the cable, the contact holder having contact channels extending between the front and the rear;

a first contact received in the corresponding channel of the contact holder, the first contact having a mating end and a terminating end, the terminating end having a first weld edge welded to the first conductor end at a first butt weld, wherein the terminating end of the first contact includes a first side and a second side opposite the first side, the first weld edge extending between the first and second sides;

a second contact received in the corresponding channel of the contact holder, the second contact having a mating end and a terminating end, the terminating end having a second weld edge welded to the second conductor end at a second butt weld, wherein the terminating end of the second contact includes a first side and the second side opposite the first side, the second weld edge extending between the first side and the second side; and a ground shield coupled to the contact holder and providing electrical shielding for the first and second contacts, the ground shield being electrically connected to the cable shield;

wherein the first signal conductor has a diameter greater than a thickness of the first contact between the first and second sides such that the first signal conductor is beyond the first side of the first contact and beyond the second side of the first contact, and wherein the second signal conductor has a diameter greater than a thickness of the second contact between the first and second sides such that the second signal conductor is beyond the first side of the second contact and beyond the second side of the second contact.

11. The cable assembly of claim 10, wherein the first conductor end abuts against the first weld edge of the first contact and the second conductor end abuts against the second weld edge of the second contact.

12. The cable assembly of claim 10, wherein the first conductor end is rearward of the first weld edge such that the first conductor end does not overlap the terminating end of the first contact and the second conductor end is rearward of the second weld edge such that the second conductor end does not overlap the terminating end of the second contact.

13. The cable assembly of claim 10, wherein the first conductor end has a circular weld interface abutting against the first weld edge and the second conductor end has a circular weld interface abutting against the second weld edge.

14. The cable assembly of claim 10, wherein the first exposed segment is straight from the insulator to the first conductor end, and wherein the second exposed segment is straight from the insulator to the second conductor end.

15. An electrical connector comprising:

a housing having a front and a rear; and a plurality of cable assemblies coupled to the housing and extending from the rear of the housing, each cable assembly comprising:

a cable having a cable core including a first signal conductor and a second signal conductor separated by at least one insulator, the first signal conductor includes a first exposed segment extending forward of the first insulator to a first conductor end, the second signal conductor includes a second exposed segment extending forward of the second insulator to a second conductor end, the cable having a cable shield surrounding the cable core providing electrical shielding along a length of the cable;

a contact holder extending between a front and a rear, the contact holder located forward of the cable, the contact holder having contact channels extending between the front and the rear;

a first contact received in the corresponding channel of the contact holder, the first contact having a mating end and a terminating end, the terminating end having a first weld edge welded to the first conductor end at a first butt weld, wherein the terminating end of the first contact includes a first side and a second side opposite the first side, the first weld edge extending between the first and second sides;

a second contact received in the corresponding channel of the contact holder, the second contact having a mating end and a terminating end, the terminating end having a second weld edge welded to the second conductor end at a second butt weld, wherein the terminating end of the second contact includes a first side and the second side opposite the first side, the second weld edge extending between the first side and the second side; and a ground shield coupled to the contact holder and providing electrical shielding for the first and second contacts, the ground shield being electrically connected to the cable shield;

wherein the first signal conductor has a diameter greater than a thickness of the first contact between the first and second sides such that the first signal conductor is beyond the first side of the first contact and beyond the second side of the first contact, and wherein the second signal conductor has a diameter greater than a thickness of the second contact between the first and second sides such that the second signal conductor is beyond the first side of the second contact and beyond the second side of the second contact.

16. The electrical connector of claim 15, wherein the first conductor end abuts against the first weld edge of the first contact and the second conductor end abuts against the second weld edge of the second contact.

17. The electrical connector of claim 15, wherein the first conductor end is rearward of the first weld edge such that the first conductor end does not overlap the terminating end of the first contact and the second conductor end is rearward of the second weld edge such that the second conductor end does not overlap the terminating end of the second contact.

* * * * *